US008474418B2

(12) United States Patent
Shikida et al.

(10) Patent No.: US 8,474,418 B2
(45) Date of Patent: Jul. 2, 2013

(54) PARTITION MEMBER FOR COOLING PASSAGE OF INTERNAL COMBUSTION ENGINE, COOLING STRUCTURE OF INTERNAL COMBUSTION ENGINE, AND METHOD FOR FORMING THE COOLING STRUCTURE

(75) Inventors: Takasuke Shikida, Okazaki (JP); Shuichi Hanai, Toyota (JP); Makoto Hatano, Obu (JP); Nobumitsu Okazaki, Akaiwa (JP)

(73) Assignees: Toyota Jidosha Kabushiki Kaisha, Toyota (JP); Aisan Kogyo Kabushiki Kaisha, Obu (JP); Uchiyama Manufacturing Corp., Okayama (JP)

( * ) Notice: Subject to any disclaimer, the term of this patent is extended or adjusted under 35 U.S.C. 154(b) by 957 days.

(21) Appl. No.: 12/309,443

(22) PCT Filed: Jul. 13, 2007

(86) PCT No.: PCT/JP2007/064385

§ 371 (c)(1),
(2), (4) Date: Feb. 25, 2009

(87) PCT Pub. No.: WO2008/010584

PCT Pub. Date: Jan. 24, 2008

(65) Prior Publication Data

US 2010/0242868 A1 Sep. 30, 2010

(30) Foreign Application Priority Data

Jul. 21, 2006 (JP) ..... 2006-199214

(51) Int. Cl.
*F02B 75/18* (2006.01)
*F02F 1/14* (2006.01)

(52) U.S. Cl.
USPC ..... 123/41.79; 123/41.74

(58) Field of Classification Search
USPC ..... 123/41.72, 41.74, 41.79, 41.82 R, 123/195 R, 41.84
See application file for complete search history.

(56) References Cited

U.S. PATENT DOCUMENTS 6,138,619 A * 10/2000 Etemad ..... 123/41.74
7,032,547 B2 * 4/2006 Xin ..... 123/41.72

(Continued)

FOREIGN PATENT DOCUMENTS

DE 101 02 644 C1 2/2002
EP 0 261 506 A2 3/1988

(Continued)

OTHER PUBLICATIONS

Matsutani et al., "Water Jacket Spacer for Improvement of Cylinder Bore Temperature Distribution," SAE Technical Paper Series, 2005-01-1156, 2005 SAE World Congress, Detroit, Michigan, Apr. 11-14, 2005.*

(Continued)

*Primary Examiner* — Noah Kamen
(74) *Attorney, Agent, or Firm* — Oliff & Berridge, PLC

(57) ABSTRACT

The position of a passage separating member in the axial direction of the cylinder bores is determined by causing a spacer to contact a bottom surface of a water jacket. When the separating member is inserted in the water jacket, the width of the separating member is reduced due to elastic deformation, so that the separating member can be arranged in the water jacket. After being arranged, the separating member tightly contacts the inner surface of the water jacket due to elastic restoration force. The tight contact prevents the separating member from moving upward in the water jacket. As a result, coolant is prevented from moving between the upper portion and the lower portion with respect to the separating member. The advantages of separate cooling of the coolant in the upper and lower portions with respect to the separating member are obtained. This reliably reduces the temperature difference along the axial direction of the cylinder bore forming body.

18 Claims, 14 Drawing Sheets

U.S. PATENT DOCUMENTS

| | | | | |
|---|---|---|---|---|
| 2002/0000210 | A1* | 1/2002 | Shinpo et al. | 123/41.74 |
| 2003/0230253 | A1 | 12/2003 | Matsutani et al. | |
| 2005/0217614 | A1 | 10/2005 | Matsutani et al. | |
| 2005/0235930 | A1 | 10/2005 | Xin | |

FOREIGN PATENT DOCUMENTS

| | | | |
|---|---|---|---|
| EP | 1 167 735 | A2 | 1/2002 |
| JP | U-2-72346 | | 6/1990 |
| JP | A-11294254 | | 10/1999 |
| JP | A-2000-345838 | | 12/2000 |
| JP | A-2002-266695 | | 9/2002 |
| JP | A-2005-315118 | | 11/2005 |

OTHER PUBLICATIONS

Matsutani et al., "Water Jacket Spacer for Improvement Cylinder Bore Temperature Distribution," SAE Technical Paper Series, 2005, pp. 1-7.

Jan. 29, 2010 Office Action issued in Chinese Patent Application No. 200780027673.4 (with translation).

Notice of Reasons for Rejection dated Feb. 1, 2011 in corresponding Japanese Patent Application No. 2006-199214 (with translation).

* cited by examiner

PARTITION MEMBER FOR COOLING PASSAGE OF INTERNAL COMBUSTION ENGINE, COOLING STRUCTURE OF INTERNAL COMBUSTION ENGINE, AND METHOD FOR FORMING THE COOLING STRUCTURE

FIELD OF THE INVENTION

The present invention relates to a partition member for a cooling passage of an internal combustion engine, a cooling structure of an internal combustion engine, and a method for forming a cooling structure of an internal combustion engine, and, more particularly, to a partition member that divides a groove-like cooling passage defined in a cylinder block of an internal combustion engine into a plurality of passages, a cooling structure employing such partition member, and a method for forming such cooling structure.

BACKGROUND OF THE INVENTION

A typical cylinder block of an engine has a groove-like cooling passage in which cooling heat medium (coolant) flows. For example, in Japanese Laid-Open Patent Publication No. 2000-345838, discloses a cooling structure in which a cooling passage is divided into a plurality of passages in the direction defined by the depth of the passage. This reduces difference in the temperature in the axial direction of each cylinder bore. Specifically, the cooling structure causes a difference in the flow rate of coolant between an upper portion and a lower portion of the cooling passage to decrease the difference in the temperature in the axial direction of each cylinder bore.

In this cooling structure, a highly rigid member formed of, for example, stainless steel forms a partition member that partitions the passage in the axial direction of each cylinder bore. Further, the above-described passage is defined with limited dimension accuracy. Thus, if the partition member must be fitted independently in the passage of the cylinder block, which is formed through casting, it is extremely difficult to arrange the partition member accurately at a desired position in the passage. To solve this problem, in Japanese Laid-Open Patent Publication No. 200-345838, the partition member and a gasket are coupled together through swaging using projecting pieces. In this manner, the partition member is suspended from the gasket at a deck surface of the cylinder block and thus positioned in the axial direction of each cylinder bore.

However, even if positioning of the partition member is accomplished accurately, an edge of the partition member may not be held in tight contact with an inner surface of the passage. In this case, the cooling heat medium may flow through the gap between the partition member and the inner surface of the passage and easily switch between the upper portion and the lower portion of the passage. This reduces the effect of the partition member, which separates the groove-like cooling heat medium passage in the axial direction of each cylinder bore.

SUMMARY OF THE INVENTION

Accordingly, it is an objective of the present invention to accurately arrange a partition member, which partitions a groove-like cooling passage in the axial direction of a cylinder bore, at a desired position in the cooling passage and to hold an edge of the partition member in tight contact with an inner surface of the cooling passage.

To achieve the foregoing objective and in accordance with a first aspect of the present invention, a partition member that divides a groove-like cooling passage formed in a cylinder block of an internal combustion engine is provided. The partition member divides the cooling passage into a plurality of passages in the direction defined by the depth of the cooling passage. A cooling heat medium flows through the cooling passage. The cooling passage has a bottom surface and a pair of opposing inner surfaces. The partition member includes a separating member and a spacer. The separating member is arranged in the cooling passage. Before being arranged in the cooling passage, the separating member has a width wider than the width of the cooling passage. The separating member is elastically deformable such that the width of the separating member can be reduced to a size that allows the separating member to be arranged in the cooling passage. The spacer has a thickness that is less than the width of the cooling passage. The spacer is arranged between the separating member and the bottom surface, thereby creating a space between the bottom surface and the separating member.

In accordance with a second aspect of the present invention, a partition member that divides a groove-like cooling passage formed in a cylinder block of an internal combustion engine is provided. The partition member divides the cooling passage into a plurality of passages in the direction defined by the depth of the cooling passage. A cooling heat medium flows through the cooling passage. The cooling passage has a bottom surface and a pair of opposing inner surfaces. The partition member includes a spacer and a separating member. The spacer has a thickness that is less than the width of the cooling passage. The spacer has a lower end arranged on the bottom surface of the cooling passage, and a pair of side surfaces each facing one of the inner surfaces. The separating member is arranged in the cooling passage. The separating member has two members each fixed to one of the side surfaces of the spacer. Before the partition member is arranged in the cooling passage, each of the two members has a width wider than a width created between an inner surface of the coolant passage and a side surface of the spacer when the partition member is arranged in the cooling passage. The separating member is elastically deformable such that the width of the separating member can be reduced to a size that allows the separating member to be arranged in the cooling passage.

In accordance with a third aspect of the present invention, a cooling structure of an internal combustion engine is provided. The partition member according to the first or second aspect of the present invention is inserted in the cooling passage of the cylinder block.

In accordance with a fourth aspect of the present invention, a method for forming a cooling structure of an internal combustion engine is provided. In this method, the partition member according to the first or second aspect of the present invention is inserted, with the spacer down, through an opening of the cooling passage provided at the upper end surface of a cylinder block until the spacer contacts the bottom surface of the cooling passage.

DETAILED DESCRIPTION OF THE PREFERRED EMBODIMENTS

A first embodiment of the present invention will now be described with reference to FIGS. 1A to 6.

Figure 1A:
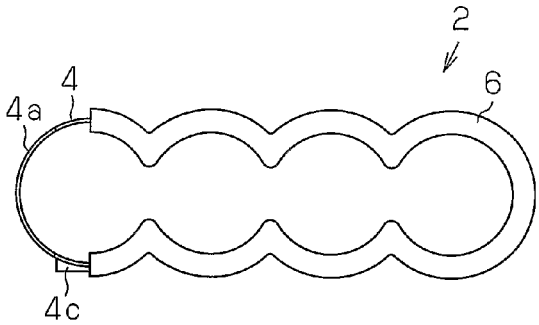
FIG. 1A is a plan view showing a partition member according to a first embodiment of the present invention.
Figure 1D:
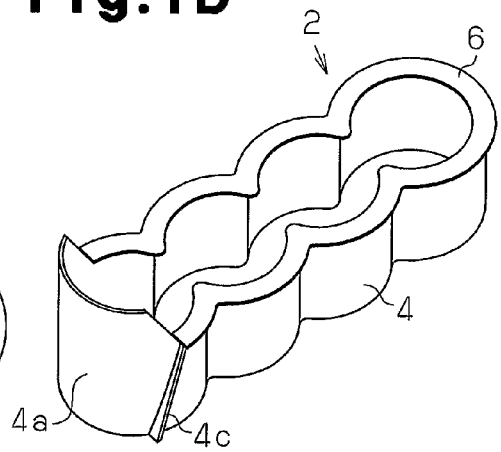
FIG. 1D is a perspective view showing the partition member shown in FIG. 1A.
Figure 1B:
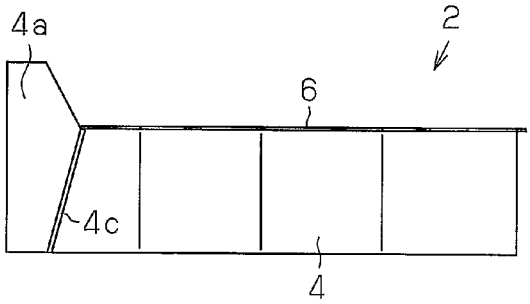
FIG. 1B is a front view showing the partition member shown in FIG. 1A.
Figure 1E:
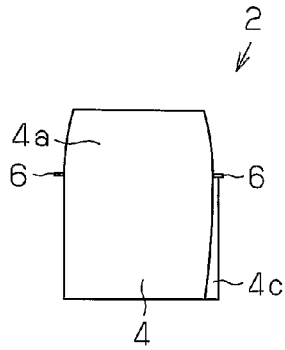
FIG. 1E is a left side view showing the partition member shown in FIG. 1A.
Figure 1C:
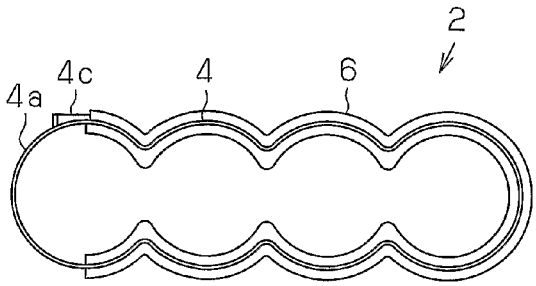
FIG. 1C is a bottom view showing the partition member shown in FIG. 1A.
Figure 1F:
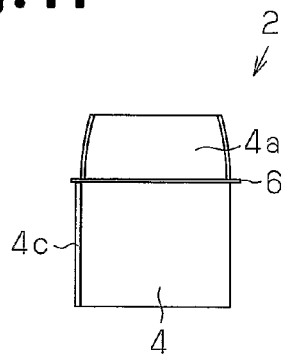
FIG. 1F is a right side view showing the partition member shown in FIG. 1A.
Figure 2:
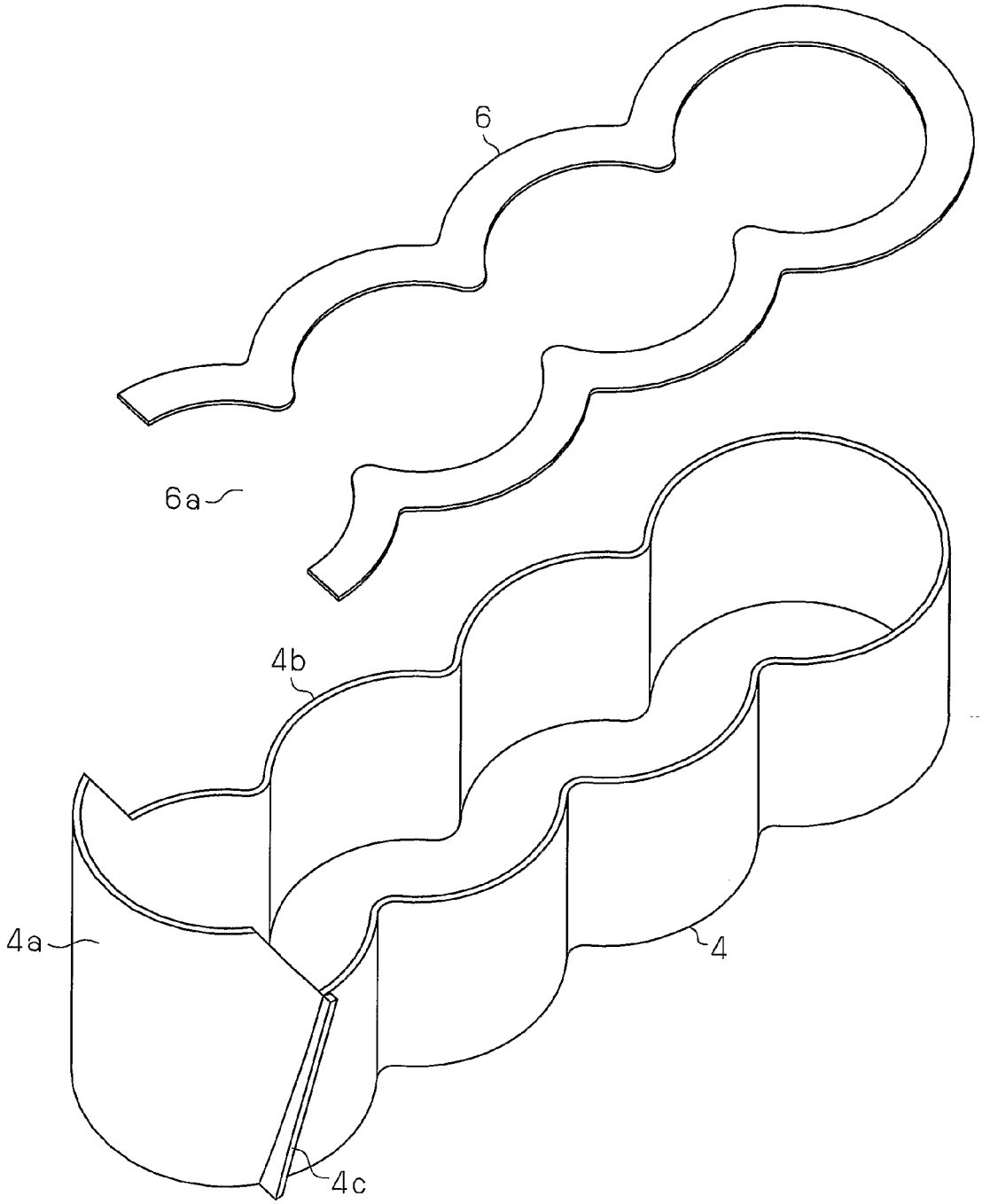
FIG. 2 is an exploded perspective view showing the partition member shown in FIG. 1A.
Figure 3:
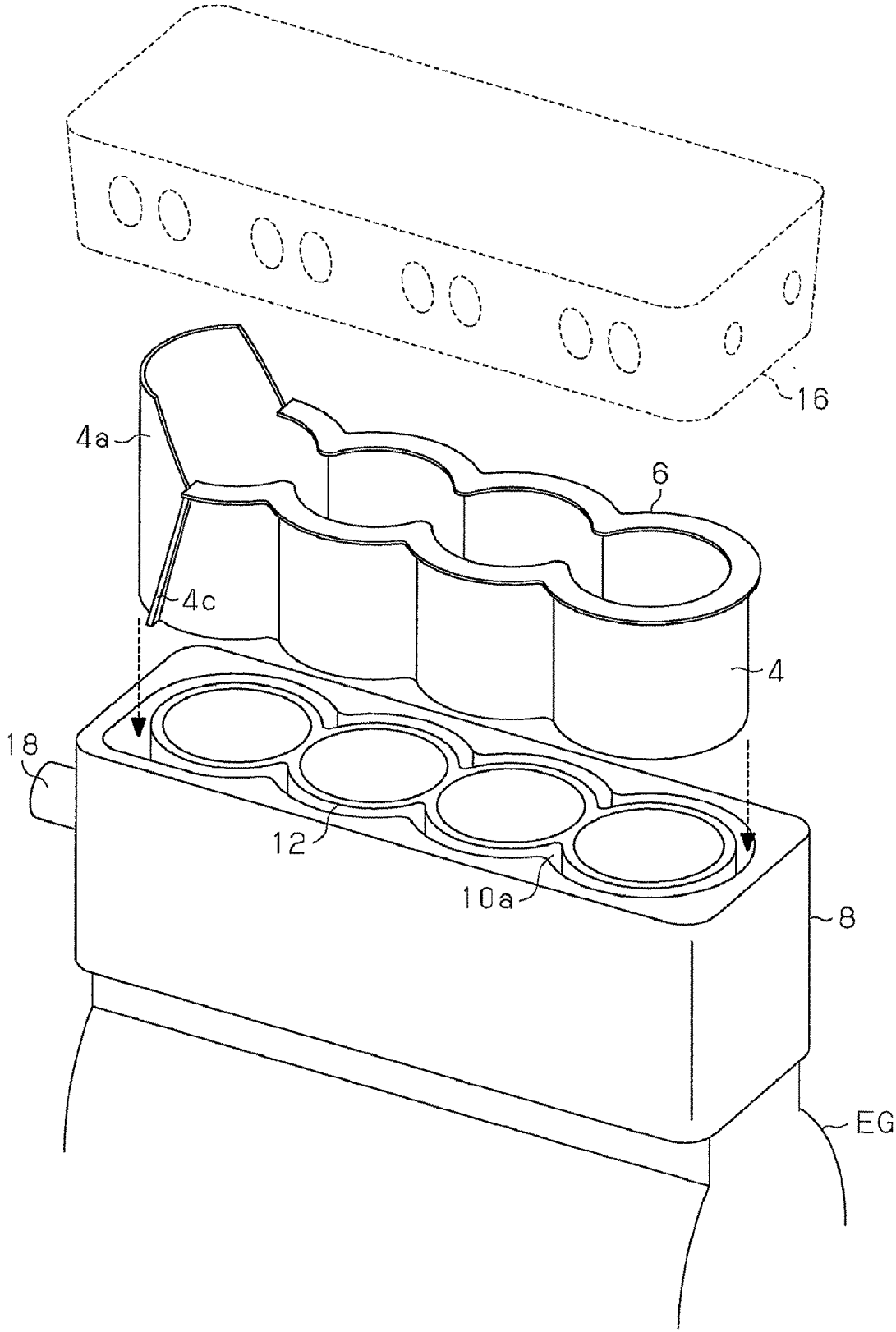
FIG. 3 is a view for explaining the assembly of the partition member of FIG. 1A into a water jacket.
Figure 4A:
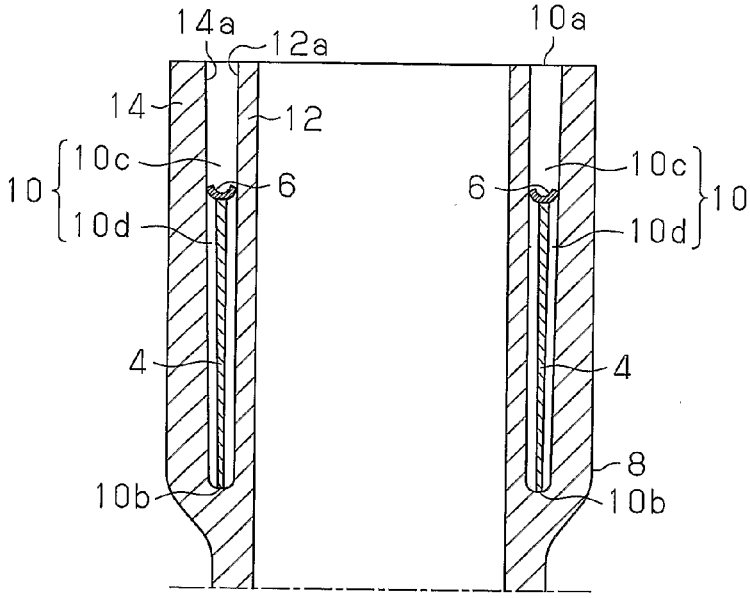
FIG. 4A is a cross-sectional view of one of first, second, third, and fourth cylinders defined in a cylinder block along a direction perpendicular to the direction in which the cylinder bores are arranged, illustrating a state in which the partition member of FIG. 1A is assembled with the water jacket.
Figure 4B:
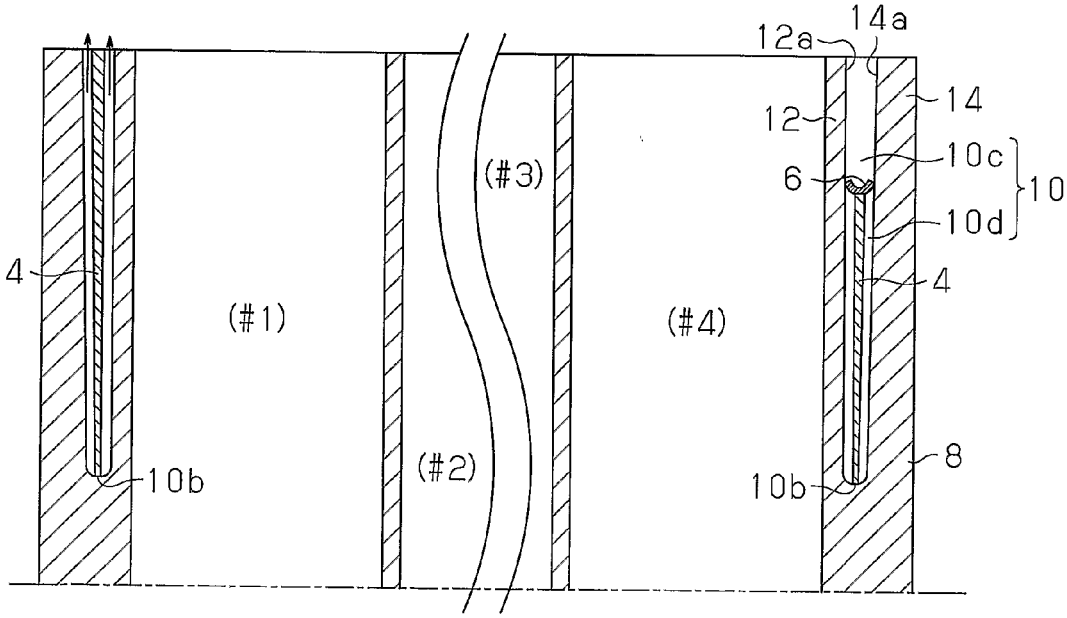
FIG. 4B is a cross-sectional view of the four cylinders in the cylinder block along the arrangement direction of the cylinder bores, illustrating a state in which the partition member shown in FIG. 1A is assembled with the water jacket.

FIGS. 1A to 2 illustrate the structure of a partition member 2 according to the present invention;

The partition member 2 includes a spacer 4 and a passage separating member 6. As shown in FIG. 3, which shows the assembly of the partition member 2 in a water jacket 10, the spacer 4 is shaped to be arranged in the water jacket (a groove-like cooling passage in which cooling heat medium flows) 10, which is defined in an open-deck type cylinder block of an engine EG. In other words, the spacer 4 is shaped as a plate the thickness of which is smaller than the width of the water jacket 10. The spacer 4 has a shape resembling connected cylinders that are provided by the number equal to the number of the cylinders (in this embodiment, four cylinders, which are first, second, third, and fourth cylinders). The engine EG is mounted in a vehicle. The width of the water jacket 10 is defined as the distance between an outer circumferential surface 12*a* of a cylinder bore forming body 12, which is shown in FIGS. 4A and 4B and will be explained later, and an inner circumferential surface 14*a* of an outer circumferential wall 14 of a cylinder block 8. The outer circumferential surface 12*a* and the inner circumferential surface 14*a* correspond to a pair of opposing inner surfaces of the water jacket 10.

With the spacer 4 shaped in the above-described manner arranged in the water jacket 10, a passage for coolant (corresponding to cooling heat medium) is ensured between the outer circumferential surface 12*a* of the cylinder bore forming body 12 and the inner circumferential surface 14*a* of the outer circumferential wall 14 of the cylinder block 8.

The spacer 4 includes a guide wall 4*a*, which is formed in a portion of the first cylinder. The guide wall 4*a* has a height equal to the depth of the water jacket 10. The guide wall 4*a* guides the coolant from the water jacket 10 to a non-illustrated water jacket (a cooling passage) provided in a cylinder head 16. The portion of the spacer 4 other than the guide wall 4*a* has a height less than the depth of the water jacket 10 and has an upper end surface 4*b* coupled to the separating member 6. The partition member 2 is formed by the spacer 4 and the partition member 6 that are provided as an integral body. A guide slope 4*c* is formed in a portion of an outer circumferential surface of the guide wall 4*a* and extends from the outer circumferential surface in the direction defined by the width of the water jacket 10. The slope 4*c* is slanted with respect to the axial direction of the cylinder bores. The upper end of the slope 4*c* is located at a first end of the separating member 6.

The separating member 6 is shaped as an elongated plate that extends along the upper end surface 4*b* of the spacer 4 and has a width greater than the width of the water jacket 10. The shape of the separating member 6 is non-continuous, unlike the spacer 4. The separating member 6 has an opening 6*a*, which is defined by an open portion of the separating member 6. The separating member 6 is coupled to the spacer 4 with the guide wall 4*a* arranged in the opening 6*a*.

To maintain the shape of the spacer 4 regardless of temperature rise in the water jacket 10 caused by the operation of the engine EG, the spacer 4 is formed of a resin with relatively high rigidity such as a polyamide type thermoplastic resin (PA66, PPA, or the like), an olefin type thermoplastic resin (PP), a polyphenylene sulfide type thermoplastic resin (PPS). Further, to increase the rigidity of the spacer 4, the spacer 4 may be reinforced with glass fiber or the like.

The separating member 6 is formed of rubber-like elastic material or other types of flexible resin. The rubber-like elastic material includes, for example, vulcanized-rubber type EPDM, silicone, and olefin type thermoplastic elastomer. Particularly, the separating member 6 is formed of a material that exhibits increased durability against the exposure to coolant.

The spacer 4 and the separating member 6 are coupled to each other with adhesive or through heat crimping, engaged or welded with each other, formed as an integral body through injection molding, or mechanically fixed together using a grommet or a clip. Alternatively, any ones of these methods may be combined to couple the spacer 4 to the separating member 6.

As illustrated in FIG. 3, the partition member 2 is inserted into the water jacket 10 through an opening of the cooling passage 10 formed at the upper end surface of the cylinder block 8, that is, through the opening 10*a* defined in a deck surface of the water jacket 10. The spacer 4 is thus arranged at the position at which the spacer 4 contacts a bottom surface 10*b* (see FIGS. 4A and 4B) of the water jacket 10. In this manner, as illustrated in the cross-sectional views of FIGS. 4A and 4B, the separating member 6 is arranged between the outer circumferential surface 12*a* of the cylinder bore forming body 12 and the inner circumferential surface 14*a* of the outer circumferential wall 14 of the cylinder block 8. In this state, the dimension of the separating member 6 in the width direction is reduced through elastic deformation of the separating member 6. Afterwards, as the separating member 6 elastically restores its original shape, the force produced by such shape restoration causes the separating member 6 to tightly contact the outer circumferential surface 12*a* of the cylinder bore forming body 12 and the inner circumferential surface 14*a* of the outer circumferential wall 14. This completely divides the portion of the water jacket 10 in which the separating member 6 is provided into an upper passage 10*c* and a lower passage 10*d*. The coolant is thus prevented from leaking between the upper passage 10*c* and the lower passage 10*d*. FIG. 4A is a cross-sectional view showing one of the cylinders as viewed along a direction perpendicular to the direction in which the cylinder bores of the first to fourth cylinders are arranged. FIG. 4B is a cross-sectional view showing the cylinder bores as viewed along the arrangement direction of the cylinder bores.

Figure 5:
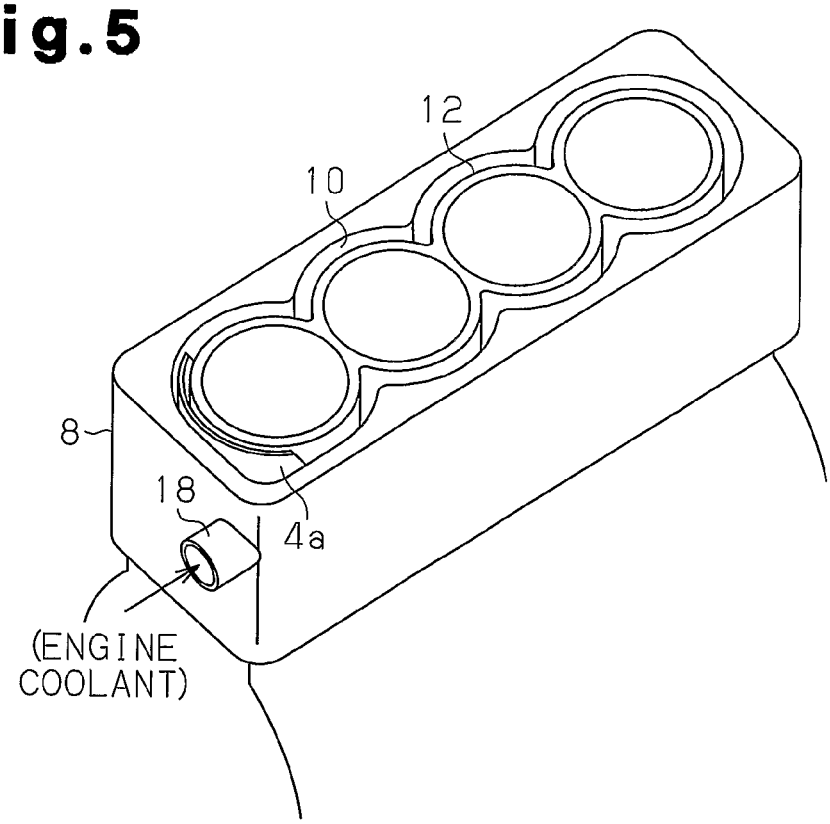
FIG. 5 is a perspective view showing the cylinder block in which the partition member in FIG. 1A is assembled with the water jacket.
Figure 6:
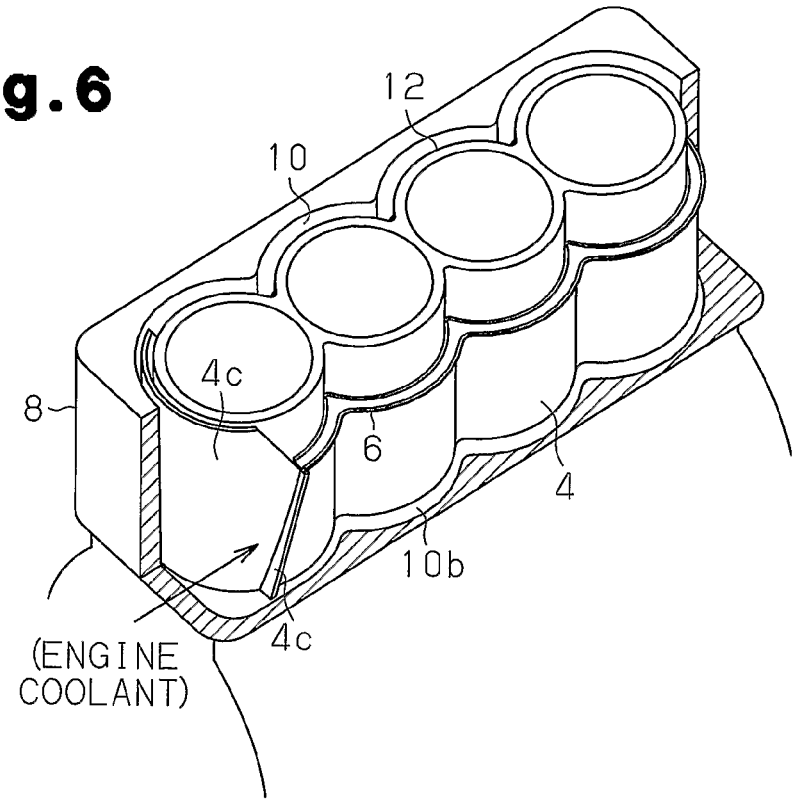
FIG. 6 is a partially cutaway view of FIG. 5.
Figure 7A:
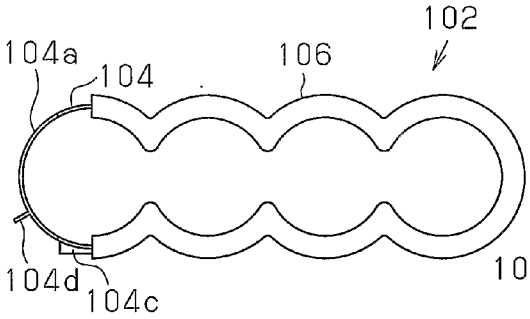
FIG. 7A is a plan view showing a partition member according to a second embodiment of the present invention.
Figure 7D:
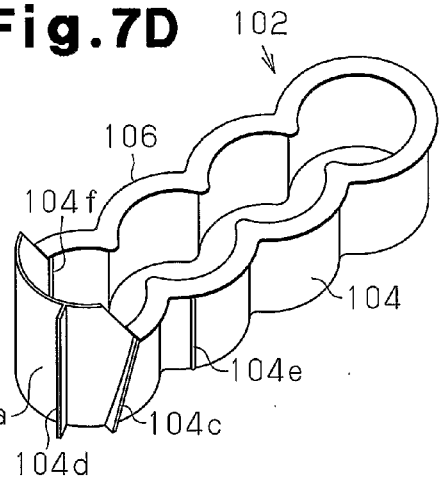
FIG. 7D is a perspective view showing the partition member shown in FIG. 7A.
Figure 7B:
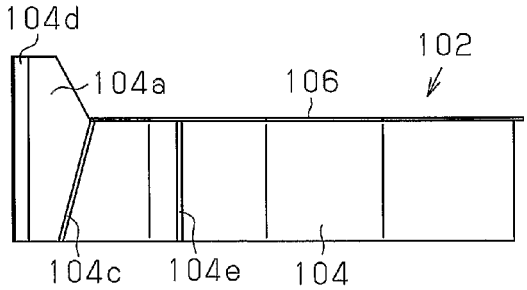
FIG. 7B is a front view showing the partition member shown in FIG. 7A.
Figure 7E:
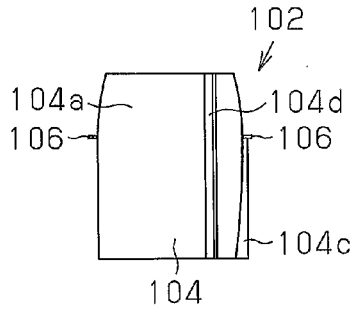
FIG. 7E is a left side view showing the partition member shown in FIG. 7A.
Figure 7C:
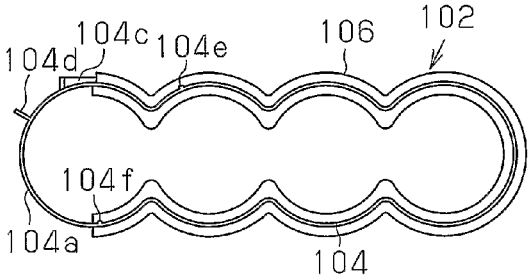
FIG. 7C is a bottom view showing the partition member shown in FIG. 7A.
Figure 7F:
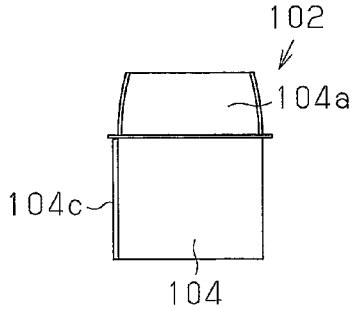
FIG. 7F is a right side view showing the partition member shown in FIG. 7A.

As illustrated in FIG. 5, when the engine EG runs, the coolant flows from a cooling water pump to the water jacket 10 through a cooling heat medium inlet line 18. Referring to the partially cutaway view of FIG. 6, the slope 4*c* is located on an imaginary line extending along the flow direction of the coolant. This guides the coolant into the upper passage 10*c*, which is located above the separating member 6. Thus, the flow rate of the coolant in the upper passage 10*c* becomes higher than the flow rate of the coolant in the lower passage 10*d*. This increases the cooling efficiency in the upper passage 10*c* compared to the cooling efficiency in the lower passage 10*d*. This suppresses difference in the temperature in the axial direction of each cylinder bore forming body 12.

The first embodiment has the following advantages.

(1) When the partition member 2 is inserted into and assembled with the water jacket 10, the spacer 4 contacts the bottom surface 10*b* of the water jacket 10. This accurately determines the position of the separating member 6 in the water jacket 10 in the axial direction of the cylinder bore forming body 12. Further, since the width of the separating member 6 is greater than the width of the water jacket 10, the separating member 6 elastically deforms when being inserted into the water jacket 10. This reduces the dimension of the separating member 6 in the width direction of the separating member 6 in such a manner that the separating member 6 is fitted in the water jacket 10. Afterwards, as the separating member 6 elastically restores its original shape, the force produced through such shape restoration causes an edge of the separating member 6 to tightly contact the inner surface of the water jacket 10. This prevents the partition member 2 from being displaced upward in the water jacket 10. Also, downward displacement of the partition member 2 is prevented by the spacer 4. The partition member 2 is thus accurately provided at a desired position in the water jacket 10 and prevented from being displaced. Further, such tight contact prevents the coolant from moving between the upper portion and the lower portion with respect to the separating member 6 through a gap between the separating member 6 and the inner surface of the water jacket 10. The flow rate of the coolant in the upper portion with respect to the separating member 6 becomes thus different from the flow rate of the coolant in the lower portion with respect to the separating member 6. The cylinder bore forming body 12 is thus sufficiently cooled and the difference in the temperature in the axial direction of the cylinder bore forming body 12 is effectively suppressed.

As has been described, the spacer 4 is prevented from being displaced upward since the separating member 6 tightly contacts the inner surface of the water jacket 10. This prevents the spacer 4 from oscillating when the engine EG runs. Accordingly, wear of the spacer 4 and interference between the spacer 4 and a gasket are also suppressed.

(2) The spacer 4 has the slope 4*c*. The coolant is thus guided from between the separating member 6 and the bottom surface 10*b* of the water jacket 10 into the upper passage 10*c* and the flow rate of the coolant in the upper passage 10*c* increases. Accordingly, without a separate mechanism that adjusts the flow rate of the coolant in the upper and lower portions with respect to the separating member 6, the flow rate of the coolant is adjusted by the partition member 2 in such a manner that the difference in the temperature in the axial direction of the cylinder bore forming body 12 decreases.

(3) The opening 6*a* is defined in the separating member 6. The guide wall 4*a*, which is higher than the other portion of the spacer 4, is formed at the position corresponding to the opening 6*a*. This structure reliably guides the coolant that has cooled the water jacket 10 of the cylinder block 8 into the water jacket of the cylinder head. This further ensures uniform cooling of the cylinder bore forming body 12.

(4) With the spacer 4 located below the separating member 6, the partition member 2 is inserted into the water jacket 10 until the partition member 2 contacts the bottom surface 10*b*. The separating member 6 is thus easily and accurately arranged at the desired position in the water jacket 10. Also, the edge of the separating member 6 tightly contacts the inner surface of the water jacket 10. Using the above-described method for forming the cooling structure of the engine, the partition member 2 is efficiently fitted in the water jacket 10 and thus the cooling structure of the engine is easily completed.

Figure 8:
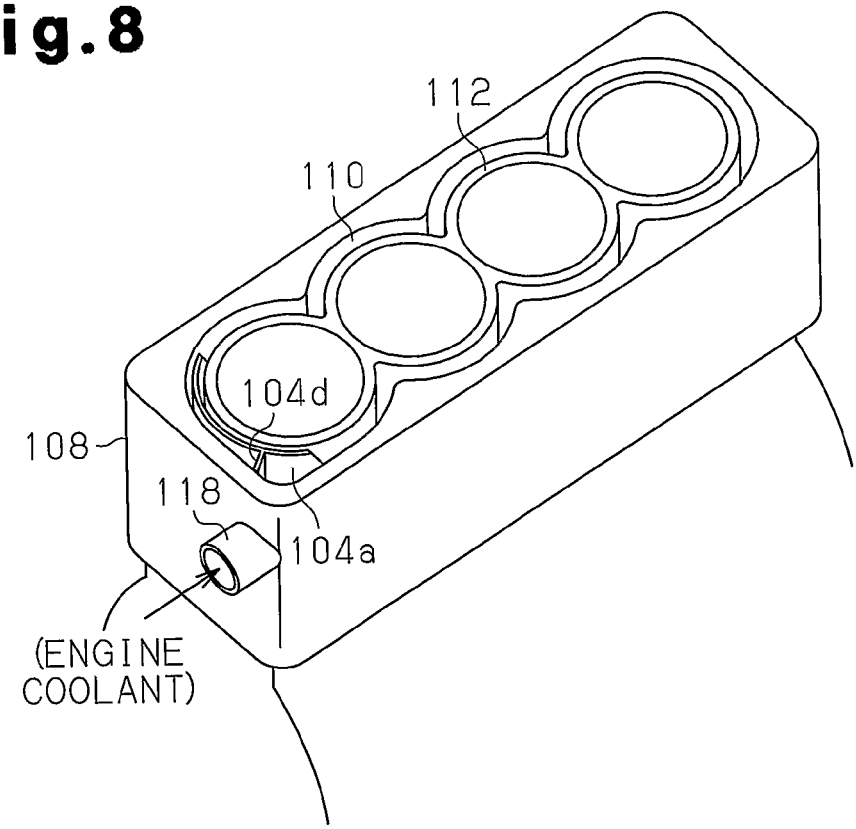
FIG. 8 is a perspective view showing a cylinder block, illustrating a state in which the partition member of FIG. 7A is assembled with a water jacket.
Figure 9:
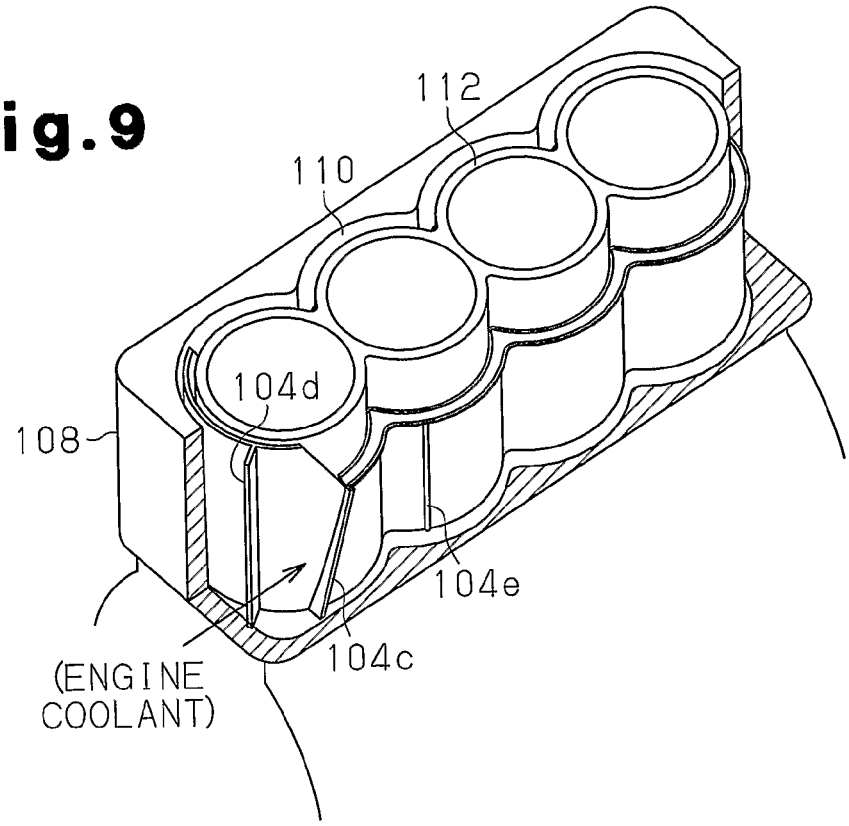
FIG. 9 is a partially cutaway view of FIG. 8.
Figure 10A:
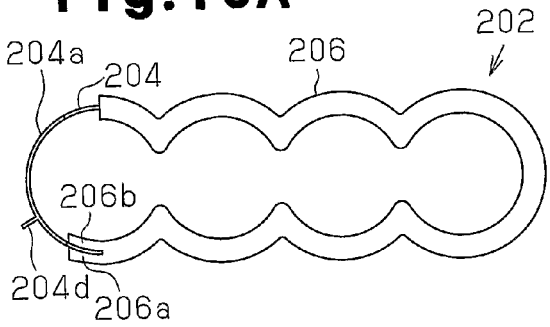
FIG. 10A is a plan view showing a partition member according to a third embodiment of the present invention.
Figure 10B:
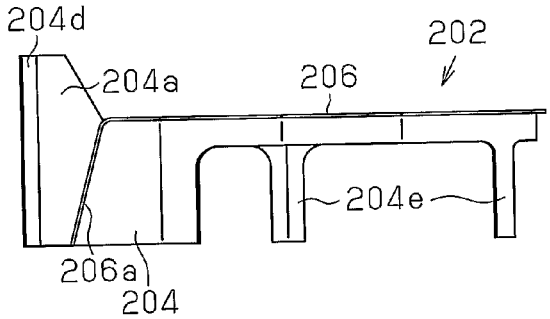
FIG. 10B is a front view showing the partition member shown in FIG. 10A.
Figure 10C:
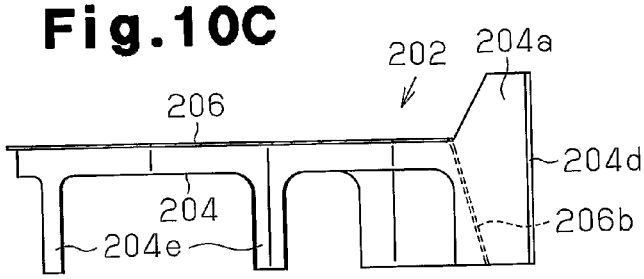
FIG. 10C is a rear view showing the partition member shown in FIG. 10A.
Figure 10D:
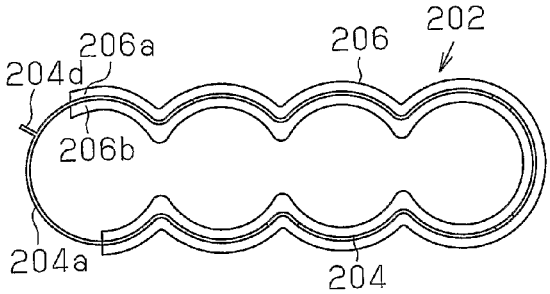
FIG. 10D is a bottom view showing the partition member shown in FIG. 10A.
Figure 10E:
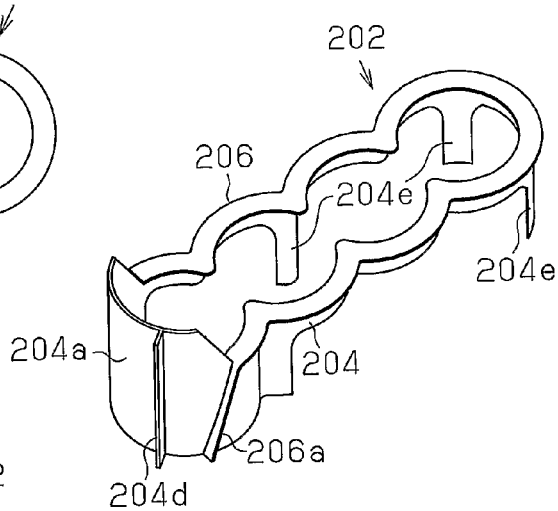
FIG. 10E is a perspective view showing the partition member shown in FIG. 10A.
Figure 10F:
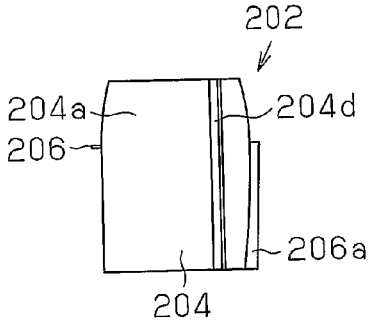
FIG. 10F is a left side view showing the partition member shown in FIG. 10A.
Figure 10G:
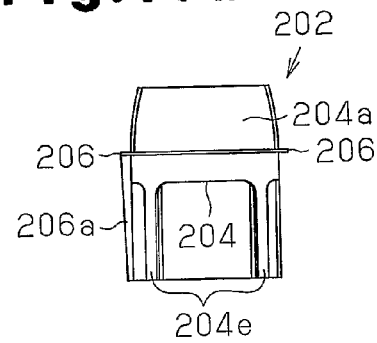
FIG. 10G is a right side view showing the partition member shown in FIG. 10A.

A partition member 102 according to a second embodiment of the present invention is illustrated in FIGS. 7A to 7F. FIGS. 8 and 9 show the partition member 102 incorporated in a water jacket 110 of a cylinder block 108. In addition to the configuration of the first embodiment, the partition member 102 includes flow rate adjustment ribs 104*d*, 104*e*, and 104*f*, which are provided at the inner and outer circumferential surfaces of the spacer 104. The other portions of the partition member 102 are configured identically with the corresponding portions of the first embodiment.

A guide slope 104*c* and the flow rate adjustment rib 104*b* are provided on the outer circumferential surface of a guide wall 104*a* of the spacer 104. The flow rate adjustment rib 104*d* is arranged adjacent to the guide slope 104*c* and extends along the entire length of the guide wall 104*a* in the axial direction of each cylinder bore. The slope 104*c* and the flow rate adjustment rib 104*d* are located at opposite positions with respect to the position at which the coolant is introduced from a cooling heat medium inlet line 118. This configuration guides the coolant from the inlet line 118 to the space between the slope 104*c* and the rib 104*d*. The rib 104*d* adjusts the distribution rate of the flow of the coolant that has been sent from the inlet line 118 between the water jacket 110 of the cylinder block 108 and a water jacket of a cylinder head. Particularly, if the projecting amount of the rib 104*d* is adjusted in such a manner that the rib 104*d* substantially blocks the passage in the water jacket 110, the flow of the coolant is restricted to a counterclockwise direction as viewed from above.

The flow rate adjustment rib 104*e*, which extends along the entire length of the spacer 104 and in the axial direction of each cylinder bore, is formed on the outer circumferential surface of the spacer 104. The flow rate adjustment rib 104*f*, which extends along the entire length of the spacer 104 and in the axial direction of each cylinder bore, is provided on the inner circumferential surface of the spacer 104. The ribs 104*e*, 104*f* adjust the cross-sectional area of a lower passage located below a separating member 106. Thus, the rib 104*e* and the rib 104*f* also adjust the ratio of the flow rate between an upper passage and the lower passage that are separated from each other by the separating member 106. Although the rib 104*e* and the rib 104*f* are located at offset positions referring to FIGS. 7C and 7D, the ribs 104*e*, 104*f* may be provided at the corresponding positions of the front surface and the back surface of the spacer 104.

The second embodiment has the following advantage.

(1) In addition to the advantages of the first embodiment, the flow direction of the coolant is adjusted in such a manner that the coolant from the inlet line 118 flows in one direction (in the counterclockwise direction as viewed from above) through adjustment of the height of the rib 104*d* provided on the guide wall 104*a*, as has been described. Further, the ribs 104*e*, 104*f* adjust the ratio of the flow rate between the upper portion and the lower portion in the water jacket 110. Thus, without a separate mechanism that adjusts the ratio of the coolant flow rate between the upper and lower portions or the flow direction of the coolant, the partition member 102 adjusts the flow rate and the flow direction of the coolant in such a manner that the difference in the temperature in the axial direction of each cylinder bore decreases.

Figure 11:
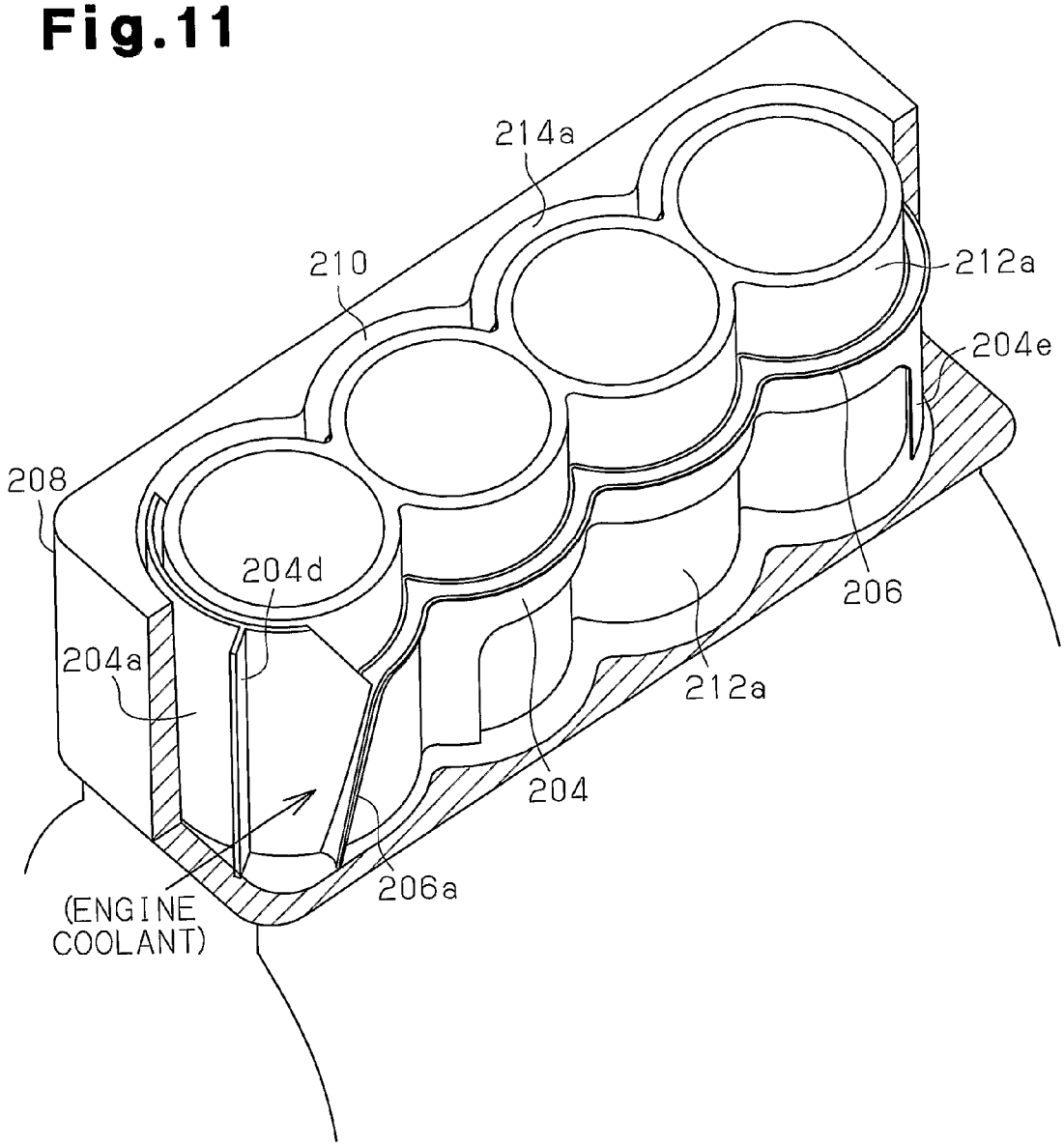
FIG. 11 is a partially cutaway perspective view illustrating a cylinder block, illustrating a state in which the partition member of FIG. 10A is assembled with a water jacket.

A partition member 202 according to a third embodiment of the present invention is shown in FIGS. 10A to 10G. FIG. 11 shows the partition member 202 incorporated in a water jacket 210 of a cylinder block 208. The partition member 202 has a flow rate adjustment rib 204*d*, which is formed on the outer circumferential surface of a guide wall 204*a*. The flow rate adjustment rib 204*b* is configured identically with the flow rate adjustment rib 104*d* (FIGS. 7A to 9) of the second embodiment. The axial length of a portion of a spacer 204 other than the guide wall 204*a* is smaller than the corresponding dimension of the spacer 104 (FIGS. 7A to 7F) of the second embodiment. The spacer 204 has leg portions 204*e*, which project from portions of the spacer 204. The length of each of the leg portions 204*e* is equal to the length of the spacer 104 (FIGS. 7A to 7F) of the second embodiment.

A guide slope 206*a* and a guide slope 206*b* are provided at an end of a passage separating member 206 in a fork-like manner. Each of the slopes 206*a*, 206*b* is formed of the rubber-like elastic material, which is the same material as the material of the separating member 206. The slope 206*a* and the slope 206*b* are fixed to the outer circumferential surface and the inner circumferential surface of the guide wall 204*a*, respectively. The configuration of the other portions of the third embodiment is identical with the configuration of the corresponding portions of the first embodiment.

The third embodiment has the following advantages.

(1) In addition to the advantages of the first embodiment, the rib 204*d* formed on the guide wall 204*a* adjusts the flow direction of the coolant that has been sent from the cooling heat medium inlet line in one direction (in a counterclockwise direction as viewed from above), like the second embodiment.

Also, since the guide slopes 206*a*, 206*b* are formed in the separating member 206, the spacer 204, which exhibits high rigidity, has less projecting portions. It is thus easy to insert the partition member 202 into the water jacket 210.

The slopes 206*a*, 206*b* are provided at the opposite sides, or the inner and outer circumferential surfaces, of the guide wall 204*a*. This makes it easy to guide the coolant to an upper passage, which is located above the separating member 206. Further, the slopes 206*a*, 206*b* are formed of the rubber-like elastic material and an edge of the slope 206*a* and an edge of the slope 206*b* are held in tight contact with an inner surface 212*a* and an inner surface 214*a* of the water jacket 210, respectively, like the separating member 206. The coolant is thus further reliably guided to the upper passage.

The partition member 202 further facilitates adjustment of the flow rate and the flow direction of the coolant in such a manner as to reduce the difference in the temperature in the axial direction of each cylinder bore.

(3) The separating member 206 is positioned sufficiently accurately by the leg portions 204*e* of the spacer 204. This saves the material needed for forming the partition member 202 as a whole. The weight of the engine EG is thus reduced.

Figure 12:
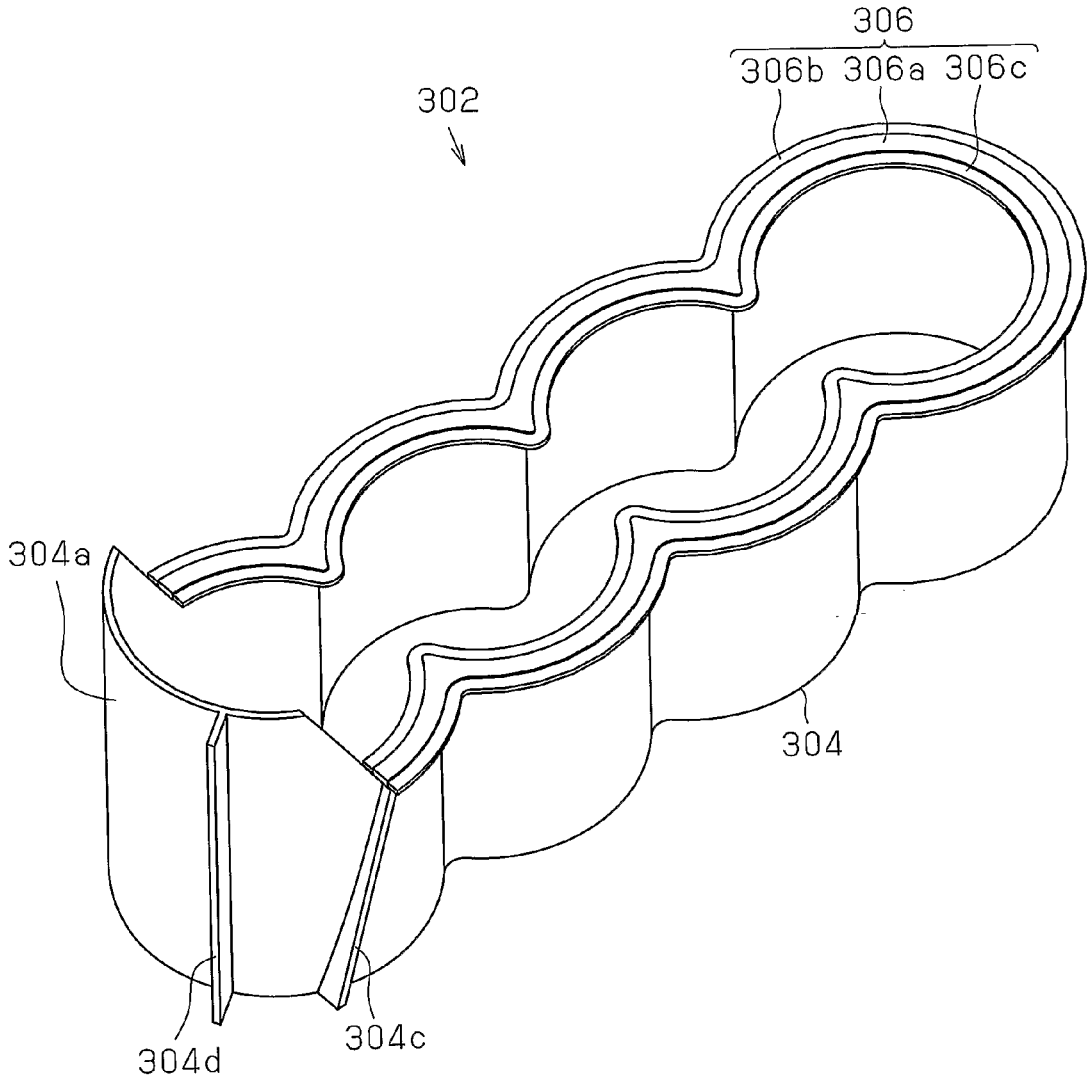
FIG. 12 is a perspective view showing a partition member according to a fourth embodiment of the present invention.

FIG. 12 is a perspective view showing a partition member 203 according to a fourth embodiment of the present invention. A guide slope 304*c* and a flow rate adjustment rib 304*d* are formed on a guide wall 304*a* of a spacer 304, which is provided in the partition member 302. The rib 304*d* is configured identically with the flow rate adjustment rib 104*d* (FIGS. 7A to 9) of the second embodiment.

Figure 13B:
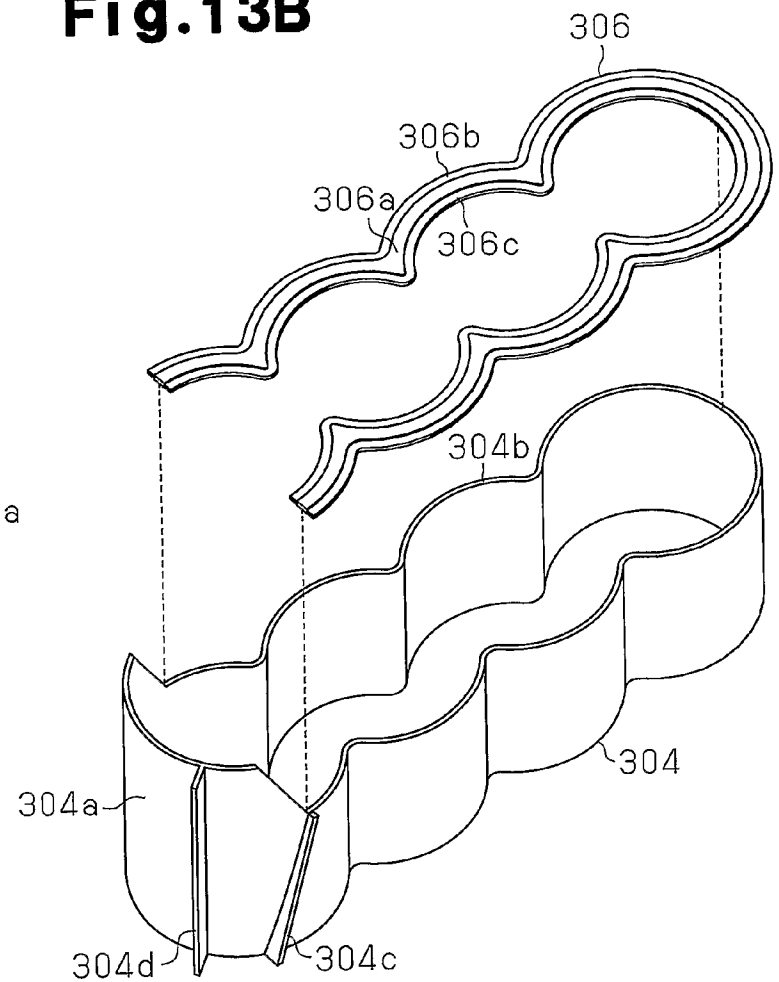
FIG. 13B is an exploded perspective view showing portions of the partition member shown in FIG. 12.
Figure 13A:
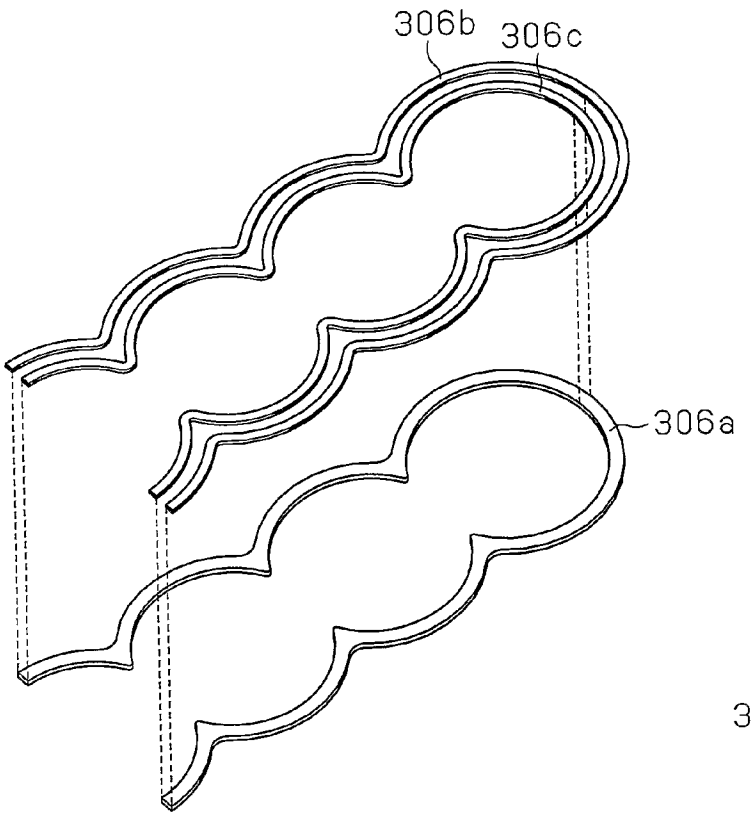
FIG. 13A is an exploded perspective view showing a passage separating member of the partition member shown in FIG. 12.

Referring to FIG. 13A, a passage separating member 306 includes a frame 306*a*, which forms a central portion of the separating member 306, and two tight contact portions 306*b*, 306*c*. The tight contact portions 306*b*, 306*c* are fixedly coupled to the opposite sides of the frame 306*a*. The frame 306*a* is formed of a highly rigid material. In the fourth embodiment, the frame 306*a* and the spacer 304 are formed of a common material (the same material as the material of the spacer 4 of the first embodiment). The tight contact portions 306*b*, 306*c* are formed of the rubber-like elastic material, which has been mentioned in the description of the first embodiment.

The tight contact portions 306*b*, 306*c* are coupled to the opposite sides of the frame 306*a* in advance to form the separating member 306. Specifically, the tight contact portions 306*b*, 306*c* and the opposite sides of the frame 306*a* are coupled to each other using adhesive or through heat crimping, engaged or welded with each other, formed as an integral body through injection molding, or mechanically fixed together using a grommet or a clip. Alternatively, any ones of these methods may be combined to couple the tight contact portions 306*b*, 306*c* to the frame 306*a*. The width of the separating member 306 is greater than the width of the water jacket of the cylinder block. However, the tight contact portions 306*b*, 306*c* elastically deform to reduce the size of the separating member 306 in the direction defined by the width of the separating member 306. The separating member 306 is thus fitted in the water jacket.

As illustrated in FIG. 13B, a lower surface of the frame 306*a* and an upper surface 304*b* of the spacer 304 are coupled to each other in such a manner that the separating member 306 and the spacer 304 form an integral body. The partition member 302 is thus completed.

The fourth embodiment has the following advantages.

(1) In addition to the advantages of the first embodiment, the rib 304*d* formed on the guide wall 304*a* adjusts the flow direction of the coolant that has been sent from the cooling heat medium inlet line in one direction (in a counterclockwise direction as viewed from above), like the second embodiment.

(2) The tight contact portions 306*b*, 306*c*, which form edges of the separating member 306 that tightly contact the inner surface of the water jacket, are formed solely of the rubber-like elastic material.

Thus, the portion of the separating member 306 other than these edges, or the frame 306*a*, is formed of a highly rigid material. If the width of the separating member 306 must be changed in correspondence with the width of the water jacket, the width of the frame 306*a* is adjusted in such a manner that the separating member 306 tightly contacts the inner surface of the water jacket and the rigidity of the separating member as a whole is maintained in an optimal state. That is, regardless of changes of the width of the separating member 306 in correspondence with the width of the water jacket, which may be varied depending on the type of the engine EG, the tight contact performance and the rigidity of the separating member 306 are maintained in desirable states.

Figure 14:
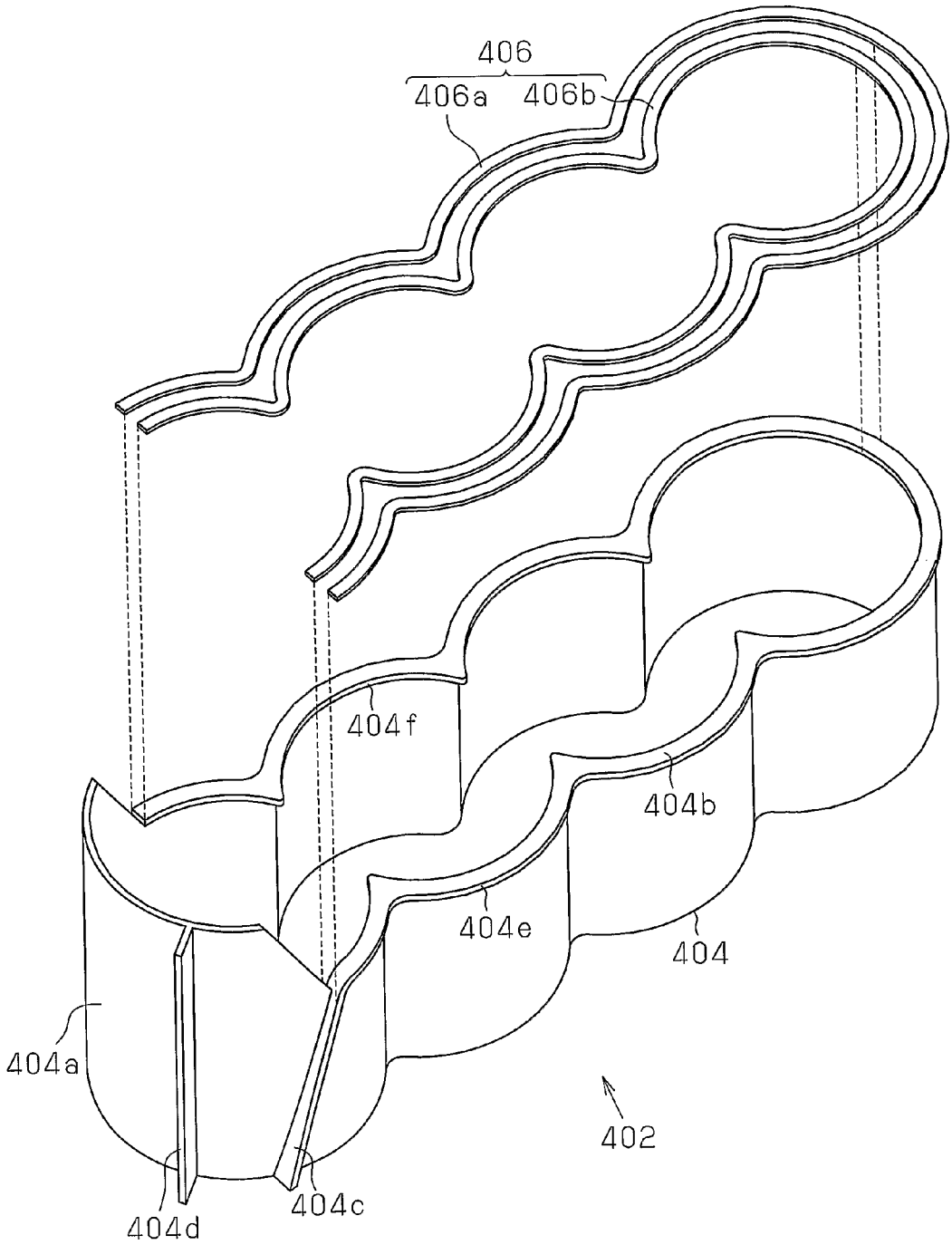
FIG. 14 is an exploded perspective view showing a partition member according to a fifth embodiment of the present invention.

FIG. 14 is an exploded perspective view showing a partition member 402 according to a fifth embodiment of the present invention. The partition member 402 is similar to the fourth embodiment in that a guide slope 404*c* and a flow rate adjustment rib 404*d* are formed on a guide wall 404*a* of a spacer 404. A frame 404*b* is formed on an upper surface of the spacer 404. The slope 404*c* is formed continuously from the frame 404*b*.

A member 406*a*, which is formed of rubber-like elastic material, is coupled to an outer circumferential surface 404*e* of the frame 404*b*. A member 406*b*, which is formed of rubber-like elastic material, is coupled to an inner circumferential surface 404*f* of the frame 404*b*. In this manner, the partition member 402 is configured substantially identically with the configuration of the fourth embodiment, which is shown in FIG. 12. The configuration of the other portions of the fifth embodiment is identical with the configuration of the corresponding portions of the first embodiment.

The width of the member 406*a*, which is located outward, is greater than the dimension between the inner surface of the water jacket of the cylinder block and the outer circumferential surface 404*e* of the frame 404*b*, which is a portion of the spacer 404. The width of the member 406*b*, which is located inward, is greater than the dimension between the inner surface of the water jacket of the cylinder block and the inner circumferential surface 404*f* of the frame 404*b*. The members 406*a*, 406*b* form a passage separating member 406. The members 406*a*, 406*b* elastically deform to reduce the dimension of the separating member 406 in the width direction. The separating member 406 is thus fitted in the water jacket.

The fifth embodiment has the following advantage.

(1) In addition to the advantage (1) of the fourth embodiment, an advantage similar to the advantage (2) of the fourth embodiment is obtained through adjustment of the width of the frame 404*b* of the spacer 404.

Figure 15B:
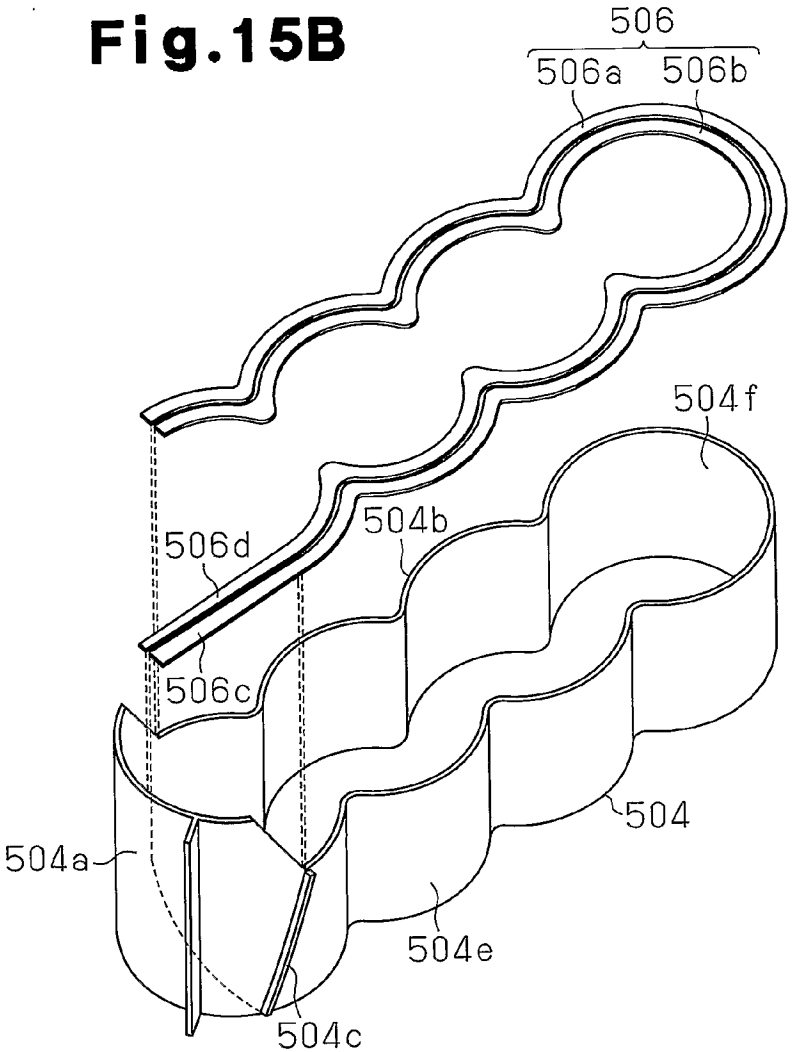
FIG. 15B is an exploded perspective view showing the partition member shown in FIG. 15A.
Figure 15A:
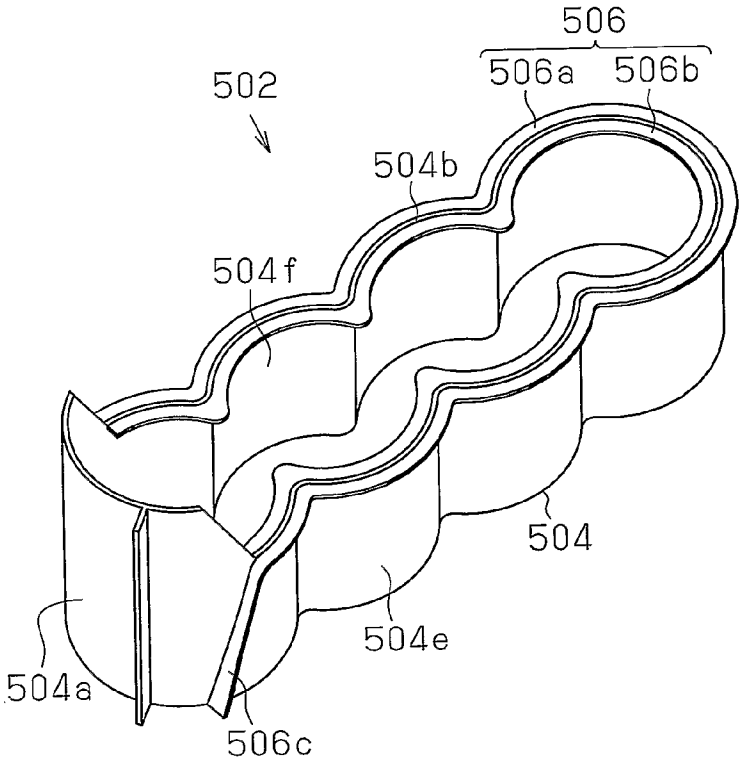
FIG. 15A is a perspective view showing a partition member according to a sixth embodiment of the present invention.

FIG. 15A is a perspective view showing a partition member 502 according to a sixth embodiment of the present invention. FIG. 15B is an exploded perspective view showing the partition member 502. The partition member 502 does not include a frame on an upper surface 504*b* of a spacer 504. Two members 506*a*, 506*b*, which form a passage separating member 506, are each coupled to a corresponding one of an outer circumferential surface 504*e* and an inner circumferential surface 504*f* of a spacer 504 at positions adjacent to the upper surface 504*b*, as in the fifth embodiment.

Slanted support portions 504*c* are each formed on a corresponding one of an inner circumferential surface and an outer circumferential surface of the guide wall 504*a*. An end of the member 506*a* and an end of the member 506*b* are coupled to the corresponding support portions 504*c*. This provides a guide slope 506*c* and a guide slope 506*d*. The configuration of the other portions of the sixth embodiment is identical with the configuration of the corresponding portions of the first embodiment.

The width of the member 506*a*, which is located outward, is greater than the dimension between the inner surface of the water jacket of the cylinder block and the outer circumferential surface 504*e* of the spacer 504. The width of the member 506*b*, which is located inward, is greater than the dimension between the inner surface of the water jacket of the cylinder block and the inner circumferential surface 504*f* of the spacer 504. The members 506*a*, 506*b* elastically deform to reduce the dimension of the separating member 506 in the width direction. The separating member 506 is thus fitted in the water jacket.

The sixth embodiment has the following advantage.

(1) An advantage similar to the advantage (1) of the third embodiment is obtained.

Other embodiments will hereafter be explained.

In each of the illustrated embodiments, the spacer is formed of the highly rigid resin. However, the spacer may be formed by a wire frame formed of wires or a metal plate.

Figure 16:
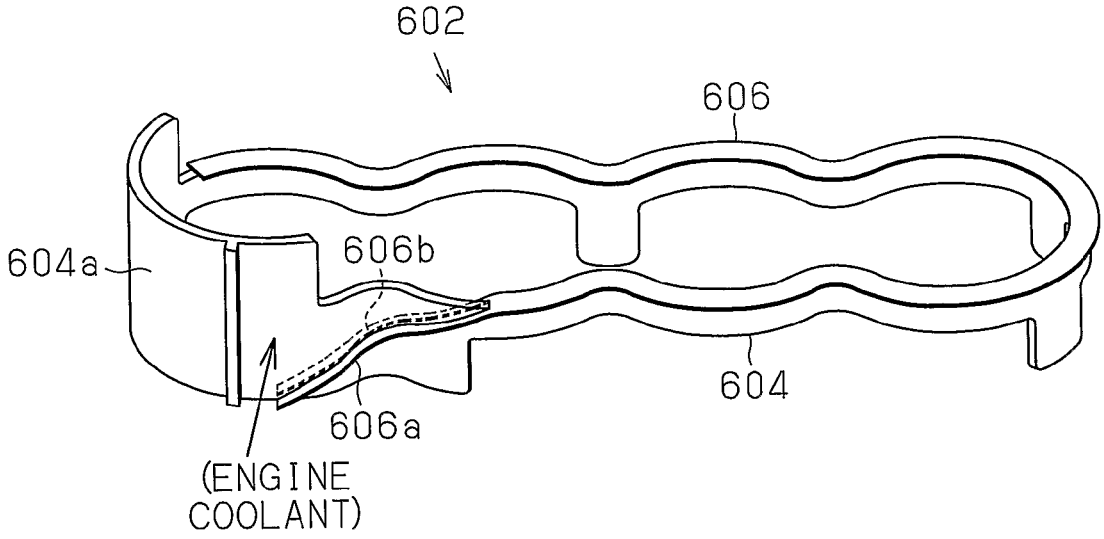
FIG. 16 is a perspective view showing a partition member according to another embodiment of the present invention.

In the third and sixth embodiments, each of the slopes is fixed to the guide wall. However, as illustrated in the perspective view of FIG. 16, a slope 606*a* and a slope 606*b* may each extend from a portion of a spacer 604 other than a guide wall 604*a* to the guide wall 604*a*. In this manner, the slopes 606*a*, 606*b* become smooth and guide the coolant further smoothly. Alternatively, the slopes 606*a*, 606*b* may be fixed only to the portion of the spacer 604 other than the guide wall 604*a* without reaching the guide wall 604*a*.

Also in the first, second, fourth, and fifth embodiments, each of the slopes may extend from the portion of the spacer other than the guide wall to the guide wall. Alternatively, each slope may be formed only in the portion of the spacer other than the guide wall.

In the second embodiment, the slope 104*c* (FIGS. 7A to 9) may be omitted. In this case, the width of each of the flow rate adjustment ribs 104*e*, 104*f* is adjusted to adjust the rate of distribution of the coolant between the upper portion and the lower portion with respect to the water jacket 110. In this manner, the difference in the temperature in the axial direction of a cylinder bore forming body 112 is decreased. In the other embodiments, flow rate adjustment ribs equivalent to the ribs 104*e*, 104*f* (FIGS. 7C, 7D, and 9) may be provided. In this case, slopes may be omitted.

The invention claimed is:

1. A partition member that divides a groove-like cooling passage formed in a cylinder block of an internal combustion engine into a plurality of passages in a direction defined by a depth of the cooling passage, wherein a cooling heat medium flows through the cooling passage, the cooling passage having a bottom surface and a pair of opposing inner surfaces, the partition member comprising:

a separating member arranged in the cooling passage, wherein, before being arranged in the cooling passage, the separating member has a width wider than a width of the cooling passage, and wherein the separating member is elastically deformable such that the width of the separating member can be reduced to a size that allows the separating member to be arranged in the cooling passage; and a spacer having a thickness that is less than the width of the cooling passage, wherein the spacer is arranged between the separating member and the bottom surface, thereby creating a distance between the bottom surface and the separating member;

wherein:

the cooling passage extends continuously to encompass all cylinder bores formed in the cylinder block, the separating member having an opening at a position that corresponds to a part of the cooling passage in a circumferential direction, the spacer extends along the entire circumference of the cooling passage, and the spacer has a guide wall at a position that corresponds to the opening of the separating member, the guide wall guiding the cooling heat medium to a cooling passage of a cylinder head, and the separating member is coupled with an upper end surface of the spacer, and the guide wall extends toward the cylinder head relative to the separating member.

2. The partition member according to claim 1, wherein the separating member is entirely formed of a rubber-like elastic material.

3. The partition member according to claim 1, wherein the separating member has an edge that tightly contacts an inner surface of the cooling passage, and wherein only the edge of the separating member is formed of a rubber-like elastic material.

4. The partition member according to claim 1, wherein the spacer has a guide slope for guiding cooling heat medium located below the separating member to a passage above the separating member.

5. The partition member according to claim 4, wherein the slope is continuous with the separating member and is formed of the same material as that of the separating member.

6. The partition member according to claim 1, wherein the spacer has a flow rate adjustment rib that adjusts the cross-sectional area of the cooling passage, thereby adjusting the flow rate of the cooling medium.

7. The partition member according to claim 1, wherein the spacer has higher rigidity than the separating member.

8. The partition member according to claim 1, wherein the cooling passage extends continuously to encompass all cylinder bores formed in the cylinder block, and wherein the spacer extends along the entire circumference of the cooling passage.

9. The partition member according to claim 1, wherein the spacer includes a guide wall, and wherein the portion of the spacer other than the guide wall has a height less than the depth of the cooling passage.

10. A cooling structure of an internal combustion engine, wherein the partition member according to claim 1 is inserted in the cooling passage of the cylinder block.

11. A method for forming a cooling structure of an internal combustion engine, wherein the partition member according to claim 1 is inserted, with the spacer down, through an opening of the cooling passage provided at the upper end surface of a cylinder block until the spacer contacts the bottom surface of the cooling passage.

12. A partition member that divides a groove-like cooling passage formed in a cylinder block of an internal combustion engine into a plurality of passages in a direction defined by a depth of the cooling passage, wherein a cooling heat medium flows through the cooling passage, the cooling passage having a bottom surface and a pair of opposing inner surfaces that define a width of the cooling passage, the partition member comprising:

a spacer having a thickness that is less than the width of the cooling passage, wherein the spacer has a lower end arranged on the bottom surface of the cooling passage, and a pair of side surfaces each facing one of the inner surfaces; and a separating member arranged in the cooling passage, wherein the separating member has two members each fixed to one of the side surfaces of the spacer, wherein, before the partition member is arranged in the cooling passage, each of the two members has a width wider than the width created between the inner surface of the coolant passage and the side surface of the spacer when the partition member is arranged in the cooling passage, and wherein the separating member is elastically deformable such that the width of the separating member can be reduced to a size that allows the separating member to be arranged in the cooling passage;

wherein:

the cooling passage extends continuously to encompass all cylinder bores formed in the cylinder block, the separating member having an opening at a position that corresponds to a part of the cooling passage in a circumferential direction, the spacer extends along the entire circumference of the cooling passage, and the spacer has a guide wall at a position that corresponds to the opening of the separating member, the guide wall guiding the cooling heat medium to a cooling passage of a cylinder head, and the separating member is coupled with an upper end surface of the spacer, and the guide wall extends toward the cylinder head relative to the separating member.

13. The partition member according to claim 12, wherein the separating member is entirely formed of a rubber-like elastic material.

14. The partition member according to claim 12, wherein the separating member has an edge that tightly contacts an inner surface of the cooling passage, and wherein only the edge of the separating member is formed of a rubber-like elastic material.

15. The partition member according to claim 12, wherein the spacer has a guide slope for guiding cooling heat medium located below the separating member to a passage above the separating member.

16. The partition member according to claim 15, wherein the slope is continuous with the separating member and is formed of the same material as that of the separating member.

17. The partition member according to claim 12, wherein the spacer has a flow rate adjustment rib that adjusts the cross-sectional area of the cooling passage, thereby adjusting the flow rate of the cooling medium.

18. The partition member according to claim 12, wherein the spacer has higher rigidity than the separating member.

* * * * *